US007165916B2

(12) United States Patent
Nanayakkara

(10) Patent No.: US 7,165,916 B2
(45) Date of Patent: Jan. 23, 2007

(54) METHOD OF ON-SITE CONSTRUCTION OF CONCRETE COLUMN AND PANEL FENCE SYSTEM

(76) Inventor: Lakdas Nanayakkara, 2065 Park Ct., Boca Raton, FL (US) 33485

( * ) Notice: Subject to any disclaimer, the term of this patent is extended or adjusted under 35 U.S.C. 154(b) by 0 days.

(21) Appl. No.: 10/923,148

(22) Filed: Aug. 19, 2004

(65) Prior Publication Data

US 2006/0039760 A1 Feb. 23, 2006

(51) Int. Cl.
*E02D 5/10* (2006.01)

(52) U.S. Cl. ..... 405/285; 405/286; 405/287

(58) Field of Classification Search ..... 256/19; 52/169.3, 169.4, 169.2, 169.1, 741.15; 405/284–287
See application file for complete search history.

(56) References Cited

U.S. PATENT DOCUMENTS 3,429,126 A * 2/1969 Wey ..... 405/267
4,957,395 A 9/1990 Nelson
5,509,249 A 4/1996 House et al.
5,524,405 A 6/1996 Byrd
5,588,786 A * 12/1996 House et al. ..... 405/285
5,887,404 A 3/1999 Kreizinger
6,199,832 B1 3/2001 Morrow

* cited by examiner

*Primary Examiner*—Sunil Singh
(74) *Attorney, Agent, or Firm*—Melvin K. Silverman; Yi Li

(57) ABSTRACT

The instant invention constitutes a method of forming a concrete column and panel wall system, comprising the steps of: auguring a vertical pile hole; excavating about the pile hole a ground level recess for a pile cap; placing vertical rebars into the auger hole and cap recess; pouring concrete in situ into the pile hole and pile cap recess; positioning a pile cap plate on the poured concrete prior to the curing thereof; positioning opposing vertical ends of pre-cast concrete panels upon opposite ends of the pile cap plate and using forms to substantially define an H-shaped above-ground geometry each having vertical rebars therein, the panel ends also having horizontal re-bars extending into the geometry, thus horizontally and vertically positioning re-bars characterize substantially an entirely above-ground length of each column resultant of the H-shaped geometry; and casting in situ within volumes defined by the forms defining the above-ground geometry. Each combination of cast columns, as such, includes a first column corresponding to the pile hole and pile cap recess, and a second above-ground cast column.

4 Claims, 22 Drawing Sheets

METHOD OF ON-SITE CONSTRUCTION OF CONCRETE COLUMN AND PANEL FENCE SYSTEM

BACKGROUND OF THE INVENTION

1. Field of the Invention

The present invention relates to a method of constructing a concrete fence including concrete columns and panels.

2. Description of the Prior Art

Reinforced concrete retaining wall systems, as are best known to the inventor, are reflected in U.S. Pat. No. 4,957,395 (1990) to Nelson; U.S. Pat. No. 5,509,249 (1996) to House et al; U.S. Pat. No. 5,524,405 (1996) to Byrd; U.S. Pat. No. 5,887,404 (1999) to Kreizinger; and U.S. Pat. No. 6,199,832 (2000) to Morrow.

The prior art, including those patents referenced above, focus solely upon methods of connection or joinder of pre-cast panels to form a retaining wall system. References such as Nelson and House above do not employ vertical columns, whether pre-cast or cast in situ, as a part of such retaining systems.

None of such art, including that of Byrd, Kreizinger and Morrow, teach in situ integral casting of the entire vertical length, both above ground and below ground of an integral column to be incorporated into a larger pre-cast panel fence system. More particularly, Byrd employs mechanical tightening means to secure pre-cast panels to vertical column elements of the system thereof. Krelzinger employs a special-purpose type panel which incorporates a hollow vertical column into vertical grooved ends of its pre-cast panel to which a concrete panel is then cast in situ and above ground from an inground footing element. Morrow relates to a column and panel concrete fence including two or more concrete footings having discrete concrete columns placed upon and attached to each footings. The columns of Morrow consist of two portions initially separated from one another along one or more planes essentially parallel to a longitudinal axis of said column, this permitting such portions to be cast so that no rough surface thereof will face outward from a resultant fence when installation of the system has been completed, this creating an aesthetically pleasing appearance. Accordingly, the system of Morrow offers advantages which are aesthetic, however, not structural.

The advantages of a single integrally cast in situ column extending from an inground depth to the top pre-cast concrete panels will become apparent from the hereinafter set forth summary, drawings and detailed description of the Invention.

SUMMARY OF THE INVENTION

The instant invention constitutes a method of forming a concrete column and panel wall system, comprising the steps of: auguring a vertical pile hole; excavating about said pile hole a ground level recess for a pile cap; placing vertical rebars into said auger hole and cap recess; pouring concrete in situ into said pile hole and pile cap recess; positioning a pile cap plate on said poured concrete prior to the curing thereof; positioning opposing vertical ends of pre-cast concrete panels upon opposite ends of said pile cap plate to, with the use of forms, define, about said panels substantially, a substantially H-shaped above-ground geometry having vertical rebars therein, said panel ends also having horizontal re-bars extending into said geometry, thus horizontally and vertically positioning re-bars substantially in an entirely above-ground length of each column resultant of said H-shaped geometry; and casting in situ within volumes defined by said forms positioned defining said H-shaped above-ground geometry. Each combination of cast columns thereby includes a first column corresponding to said pile hole and pile cap recess, and a second above-ground cast column.

The method may optionally include the steps of: prior to pouring concrete into said, said above-ground geometry setting in situ on said pile cap recess, a metal plate having opposing surfaces respectively abutting said pile cap and lower surfaces of opposing edges of said pre-cast panels; setting said metallic plates within said region of said lower surfaces of said pre-cast panels during the production thereof; and welding opposing pile cap and panel plates to each other after said casting step.

It is an object of the present invention to provide an improved method of formation of a concrete column-and panel-fence system which obviates any requirement for the providing of pre-cast or manufactured column elements of such a system.

It is another object to provide a wall structure wherein only the wall sections thereof are pre-cast.

It is a further object to provide a wall structure which wall panels thereof may be installed without necessity of lifting such panels above the columns of the system.

It is a still further object of the invention to provide a concrete columns and panel fence system which is characterized by relatively quick and economical construction thereof in the field.

The above and yet other objects and advantages of the present invention will become apparent from the hereinafter set forth Brief Description of the Drawings, Detailed Description of the Invention and claims appended herewith.

DETAILED DESCRIPTION OF THE INVENTION

Figure 1:
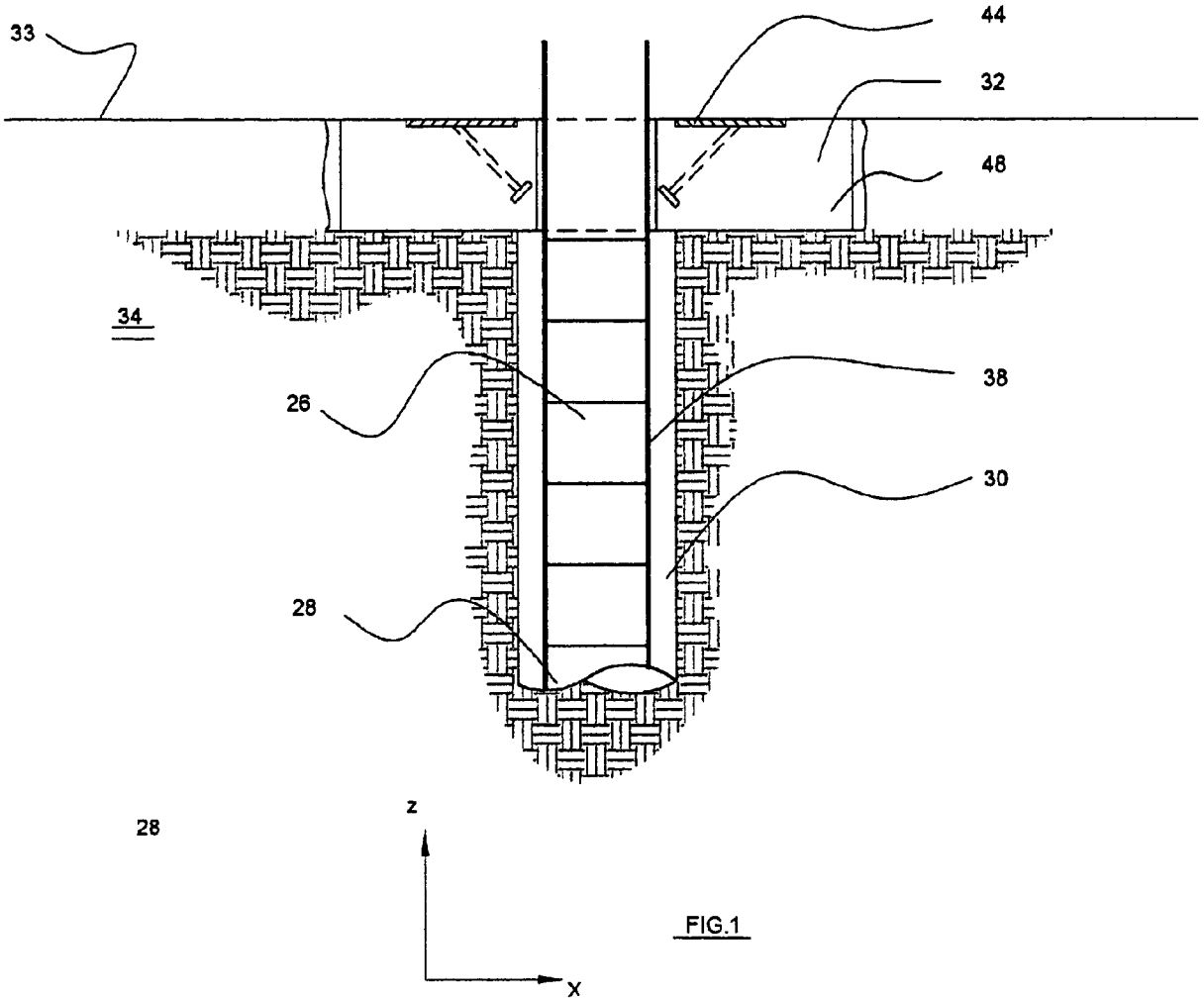
FIG. 1 is a front vertical cross-sectional schematic view of a first and second step of a first embodiment of the inventive method of constructing a concrete column and panel system.

With reference to the vertical schematic view of FIG. 1, the inventive method of forming a concrete column and panel wall system may be seen to include an initial step of auguring a vertical pile hole 30 which begins at a depth 28 and extends to a ground level 33 of soil 34. Also shown in FIG. 1 is a second step that comprises the excavating of pile hole 30 to form a ground level recess 48 into which a pile cap 32 may be poured. However, prior to pouring vertical rebars 38 are positioned within auger hole 30 and recess 48. Concrete is then poured in situ into both auger hole 30 and pile cap recess 48.

After concrete is poured in said pile hole 30 to form lower column 26 of the present system, a pile cap plate 44 is positioned on top of the cured concrete within pile cap recess 48.

Figure 2:
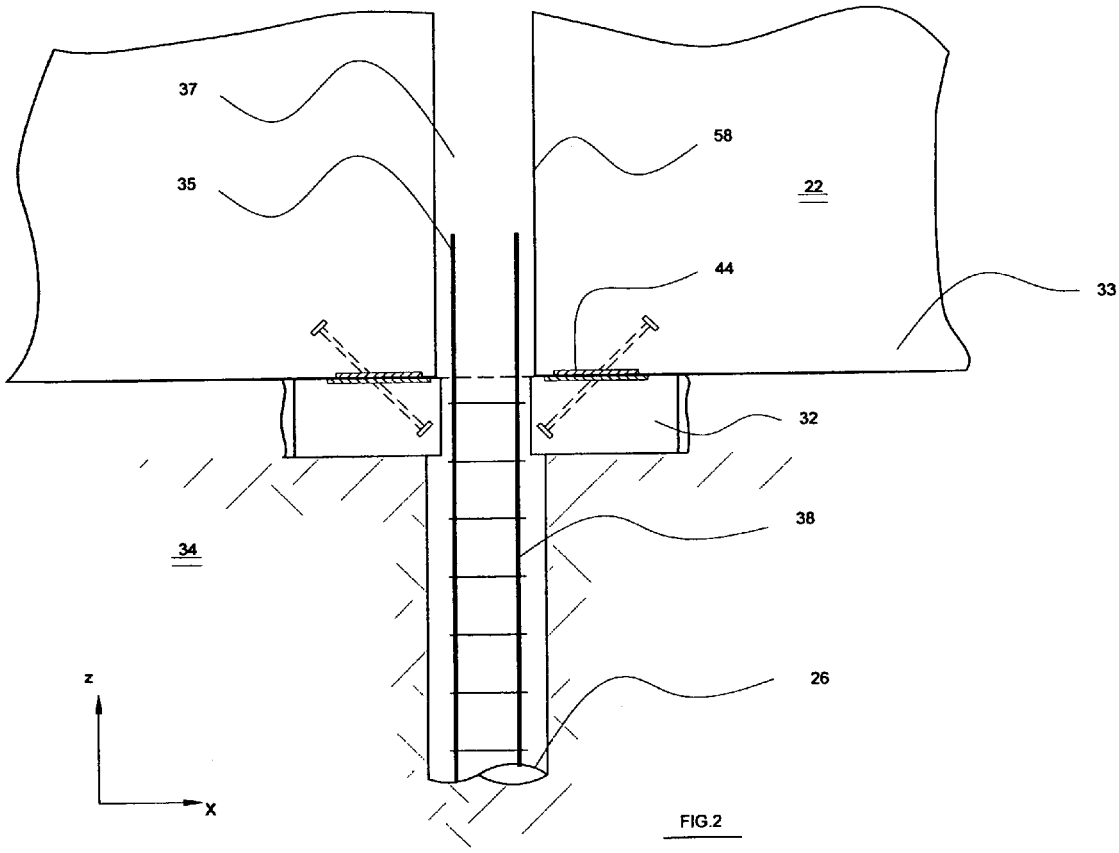
FIG. 2 is a front vertical schematic view of a third step of said method.
Figure 3:
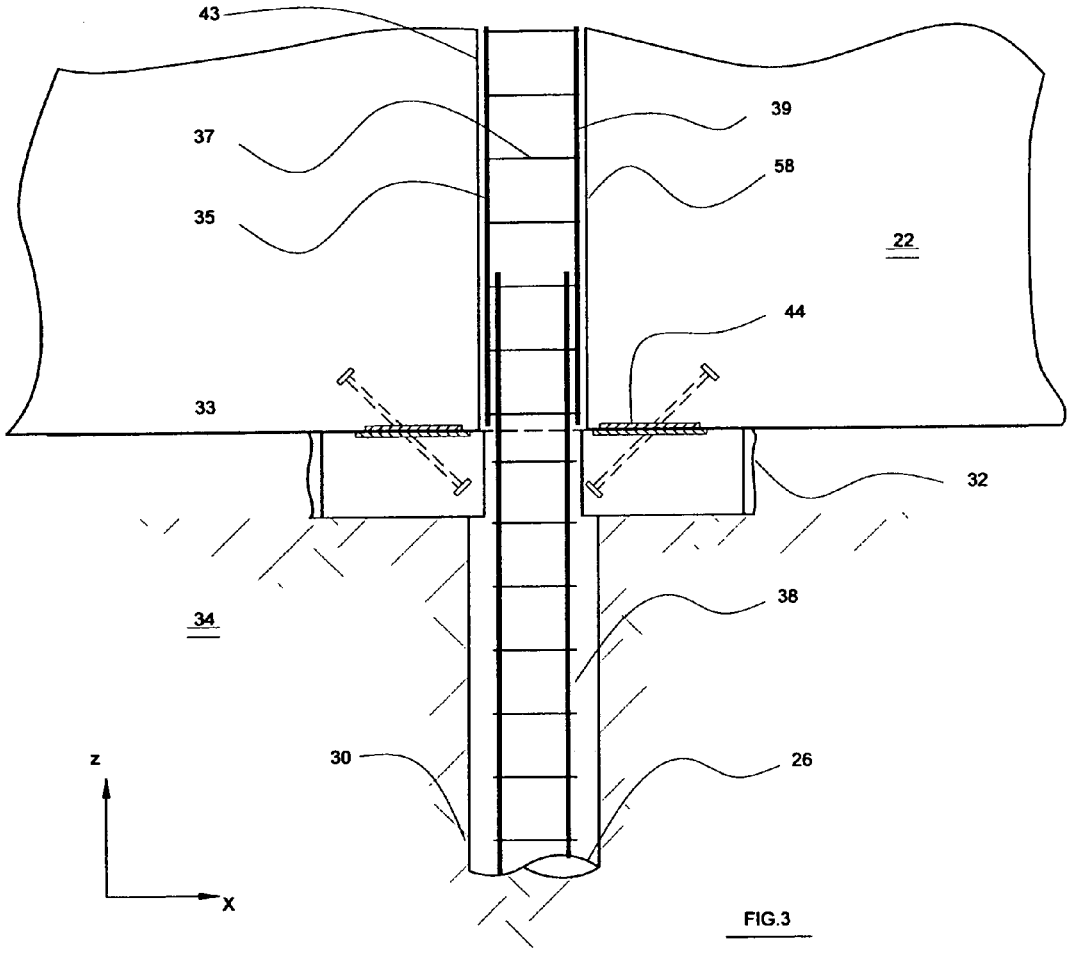
FIG. 3 is a front vertical schematic view of a fourth step therein, and taken along Line 3—3 of FIG. 6.
Figure 4:
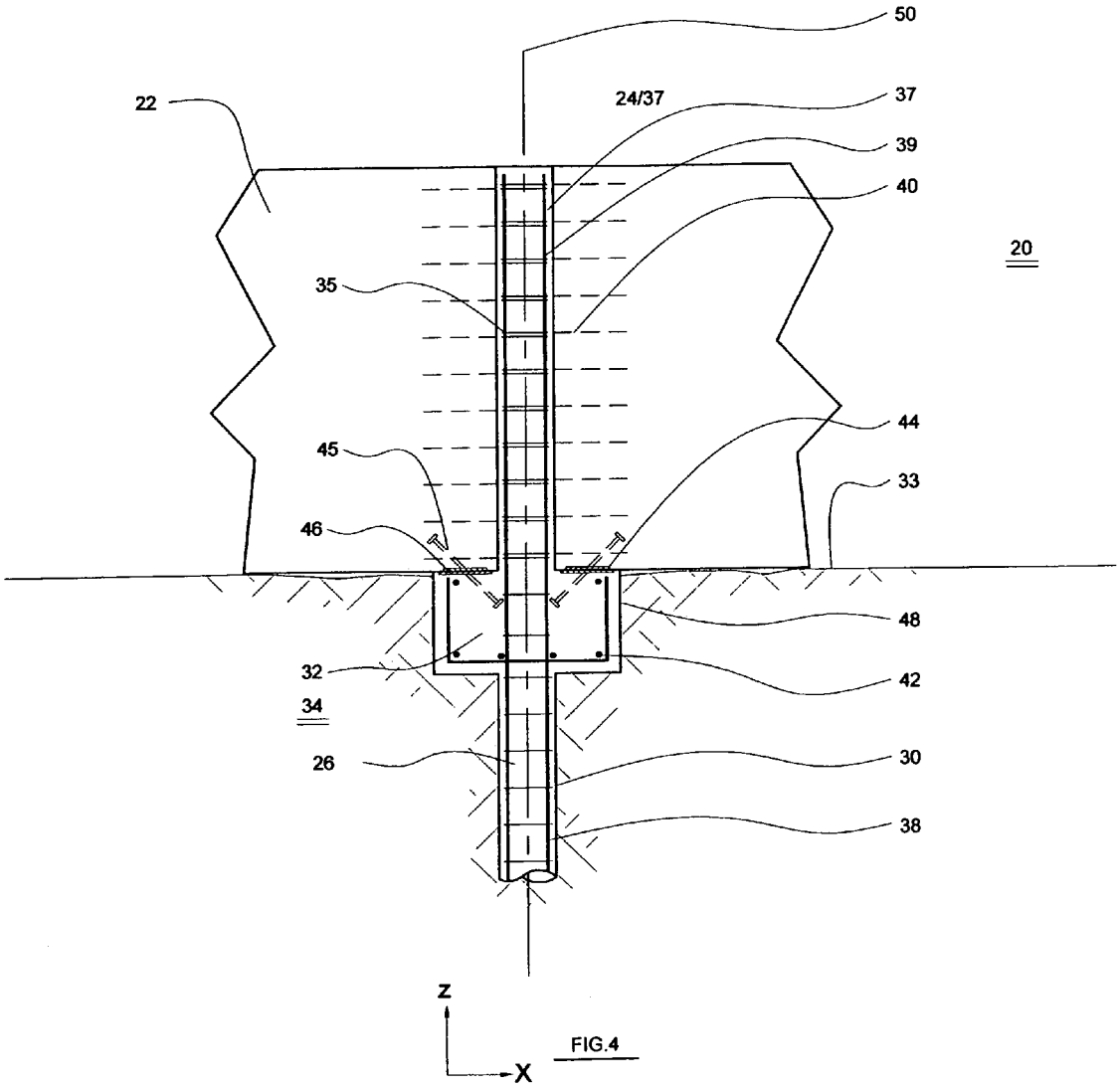
FIG. 4 is a front schematic view, similar to that of FIG. 3, showing a completed system of the inventive method.

In FIG. 2 is shown step 3 of the present process. Therein, concrete panels 22 are positioned upon the pile cap plate 44 on either side of lower column 26. Projecting horizontally from edge 35 of each panel are rebars 40. As may be noted in FIGS. 6–7, said rebars project into an H-shaped void space which exists between opposing edges 35 of panels 22. In step 4, shown in FIGS. 3 and 5 shaped form 43 is used to define said void space of upper columns 37 (see also FIG. 7) and vertical rebars 39 are provided. Thereafter, vertical column 37 is poured upon plate 44, with said vertical rebars 39 and horizontal rebars 40 of said panels 22 positioned therein. The resultant structure is more fully shown in FIG. 4 in which may be seen a single column comprising said lower column 26 and said upper column 37. The symmetry of panels 22 relative to columns 26 and 37 is shown about centerline 50. Further shown in FIG. 4 are welds 45 which are used to weld bottom plates 46 associated with panels 22 to pile plates 44 associated with pile cap recess 32. Further shown therein are internal rebars 42 which may optionally be positioned within pile cap recess 48 prior to the above-described in situ pouring of concrete in auger hole 30.

Figure 5:
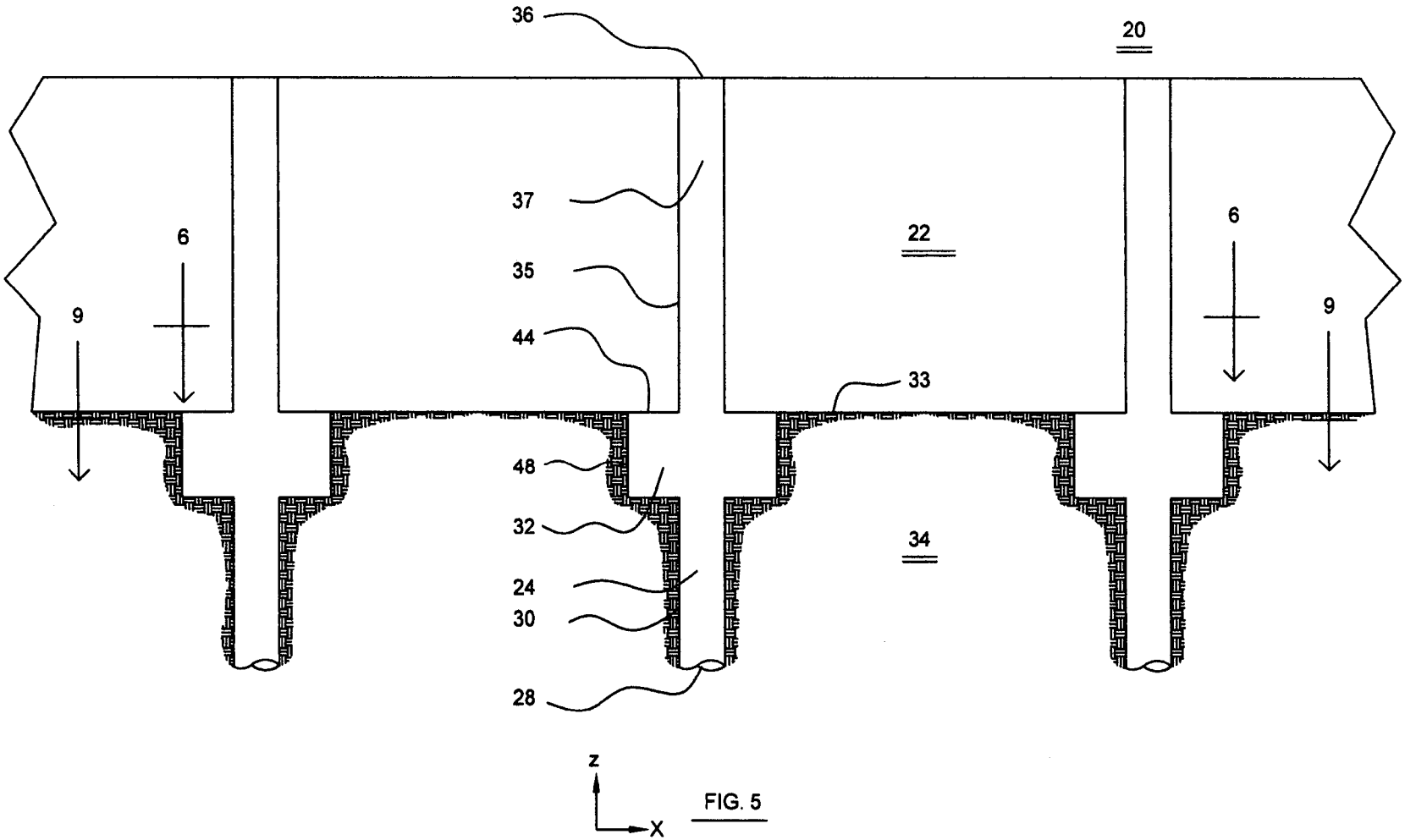
FIG. 5 is a vertical schematic view showing the appearance of multiple columns, having positionable vertical panels, in accordance with the inventive method.

A multi-panel view of the inventive system is shown in FIG. 5.

Figure 6:
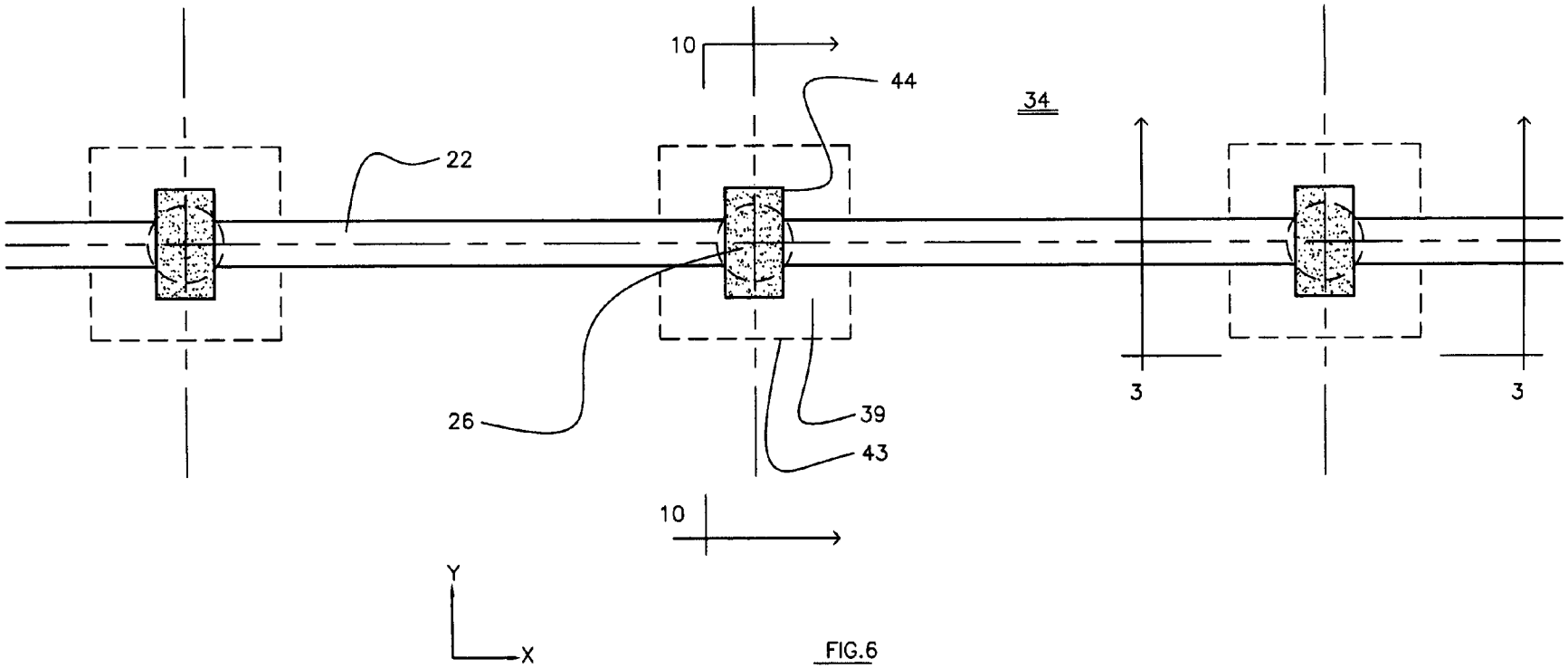
FIG. 6 is a horizontal cross-sectional view taken along Line 6—6 of FIG. 5.
Figure 6A:
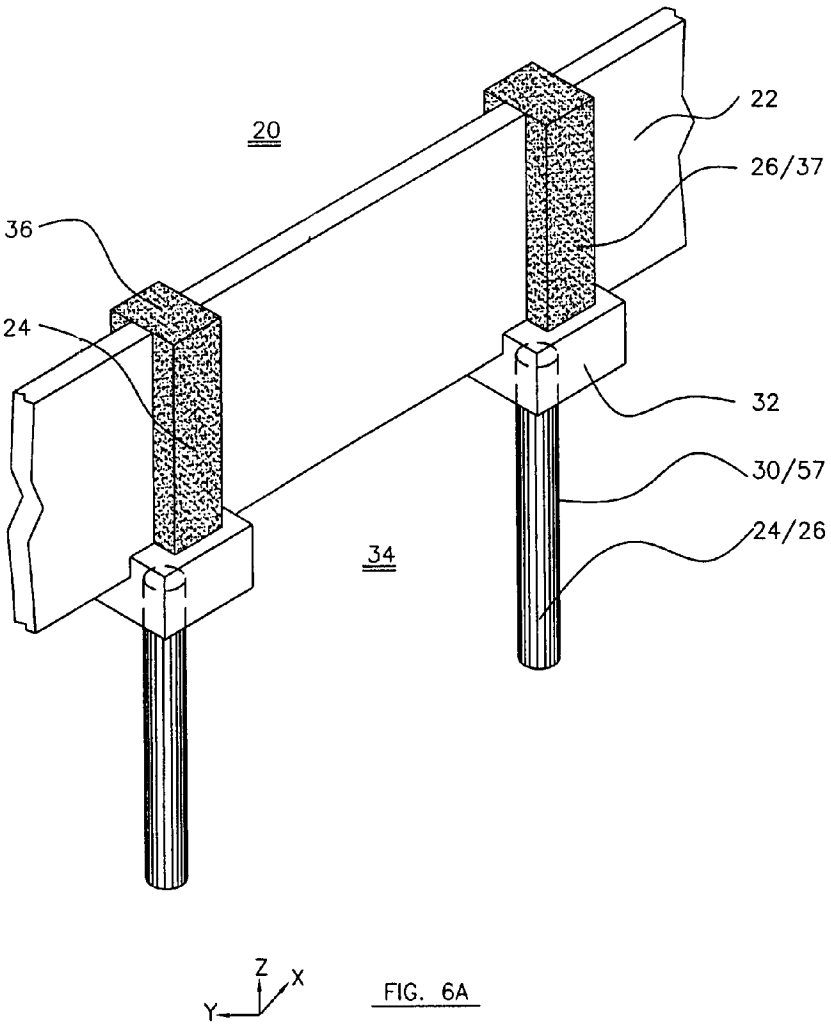
FIG. 6A is a perspective view of the embodiments of FIGS. 1 to 6.
Figure 7:
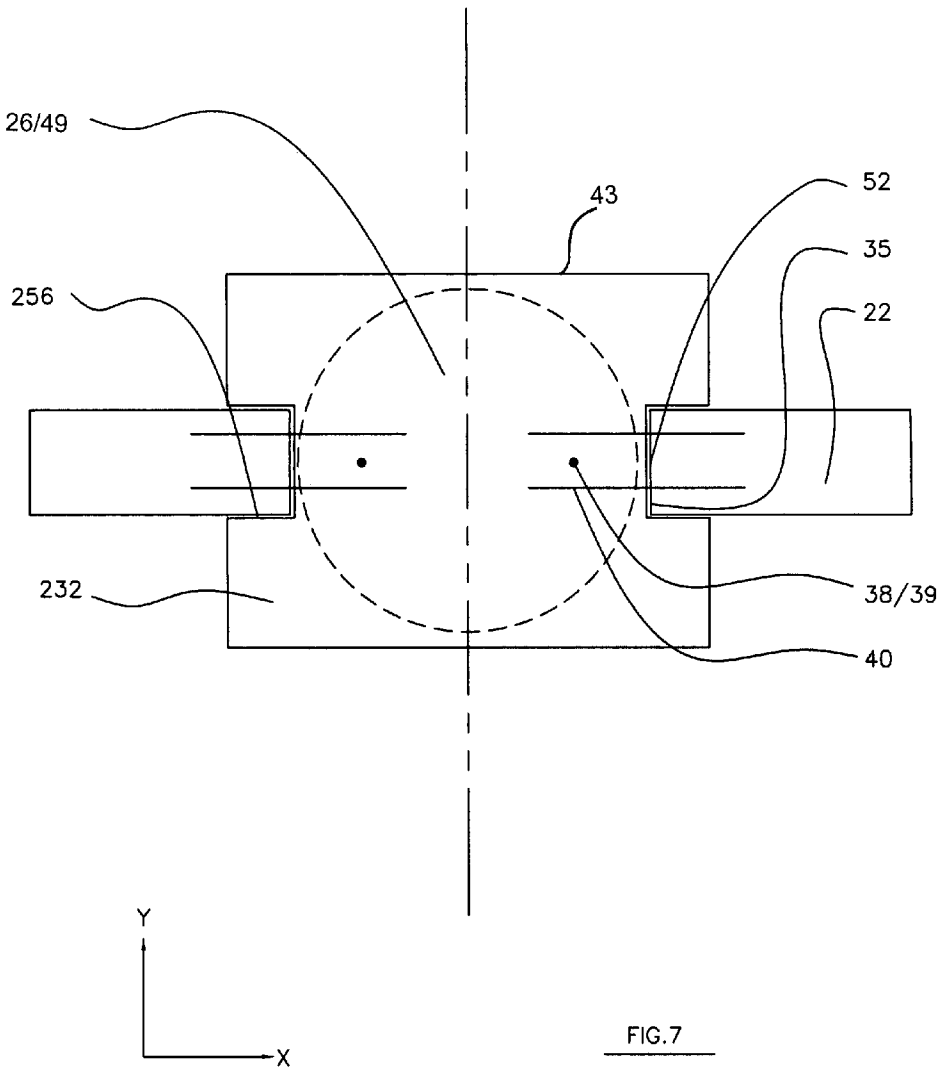
FIG. 7 is a horizontal cross-sectional view taken through Line 7—7 of FIGS. 14 and 15.
Figure 8:
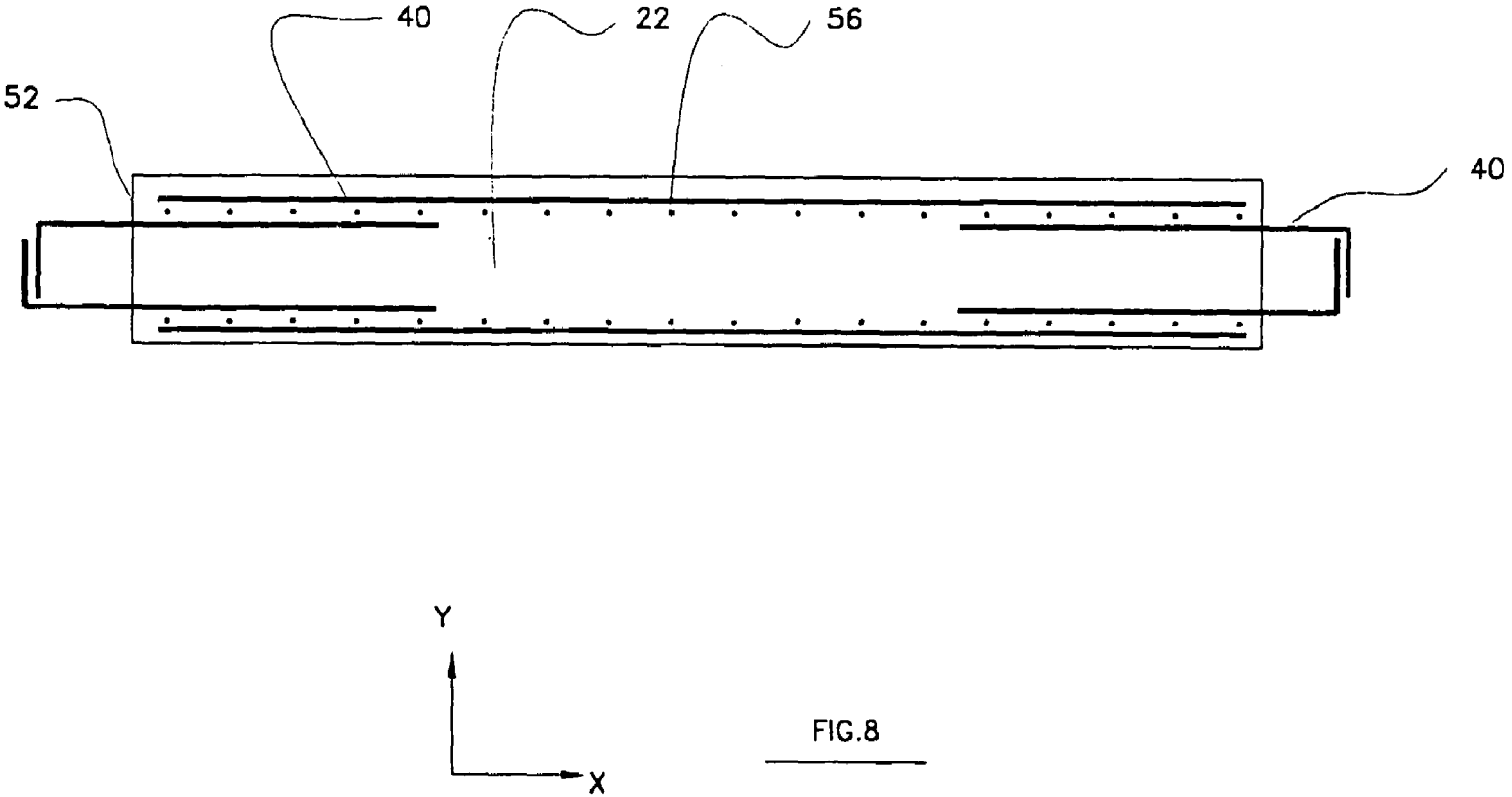
FIG. 8 is a horizontal cross-sectional schematic view of the appearance of a vertical panel prior to its use in the inventive method.
Figure 9:
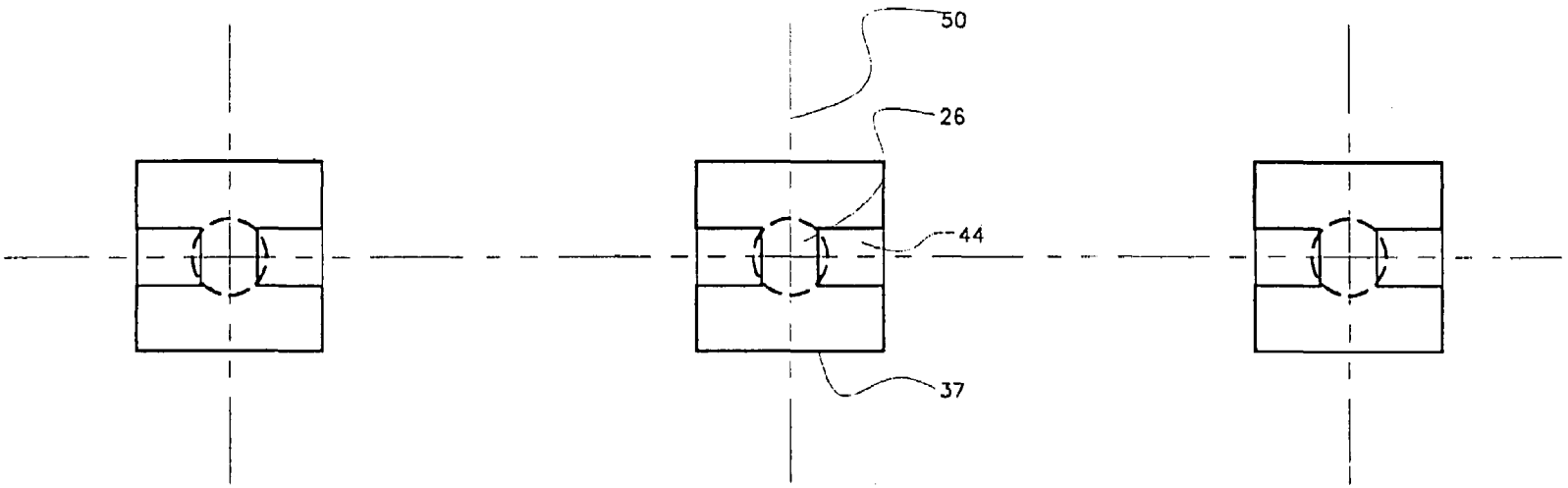
FIG. 9 is a horizontal cross-sectional view taken along Line 9—9 of FIG. 5.

In FIG. 6 is shown a cross-sectional view taken along Line 6—6 of FIG. 5. Therein may be seen in dotted lines the horizontal cross-sectional geometry of said H-shaped molds 43 which are employed to facilitate the in situ casting of upper columns 39 of the system. FIG. 6A is a perspective view of the embodiment of FIGS. 1–6. FIG. 7 is an enlarged view of a lower portion of a unit of the system taken along Line 7—7 of FIGS. 14 and 15. Therefrom may be seen the projection of horizontal rebars 40 from panels 22 into the H-shaped void space defined by mold 43 (see FIG. 6) before vertical column 37 is cast. In FIG. 8 is shown the internal rebar system of rebars 40 of wall panels 22 which, therein, also shows vertical rebars 56 which are provided in the production of the panels. In FIG. 9 is shown a horizontal cross-sectional view taken along Line 9—9 of FIG. 5 showing the structure of the present system at ground level.

Figure 10:
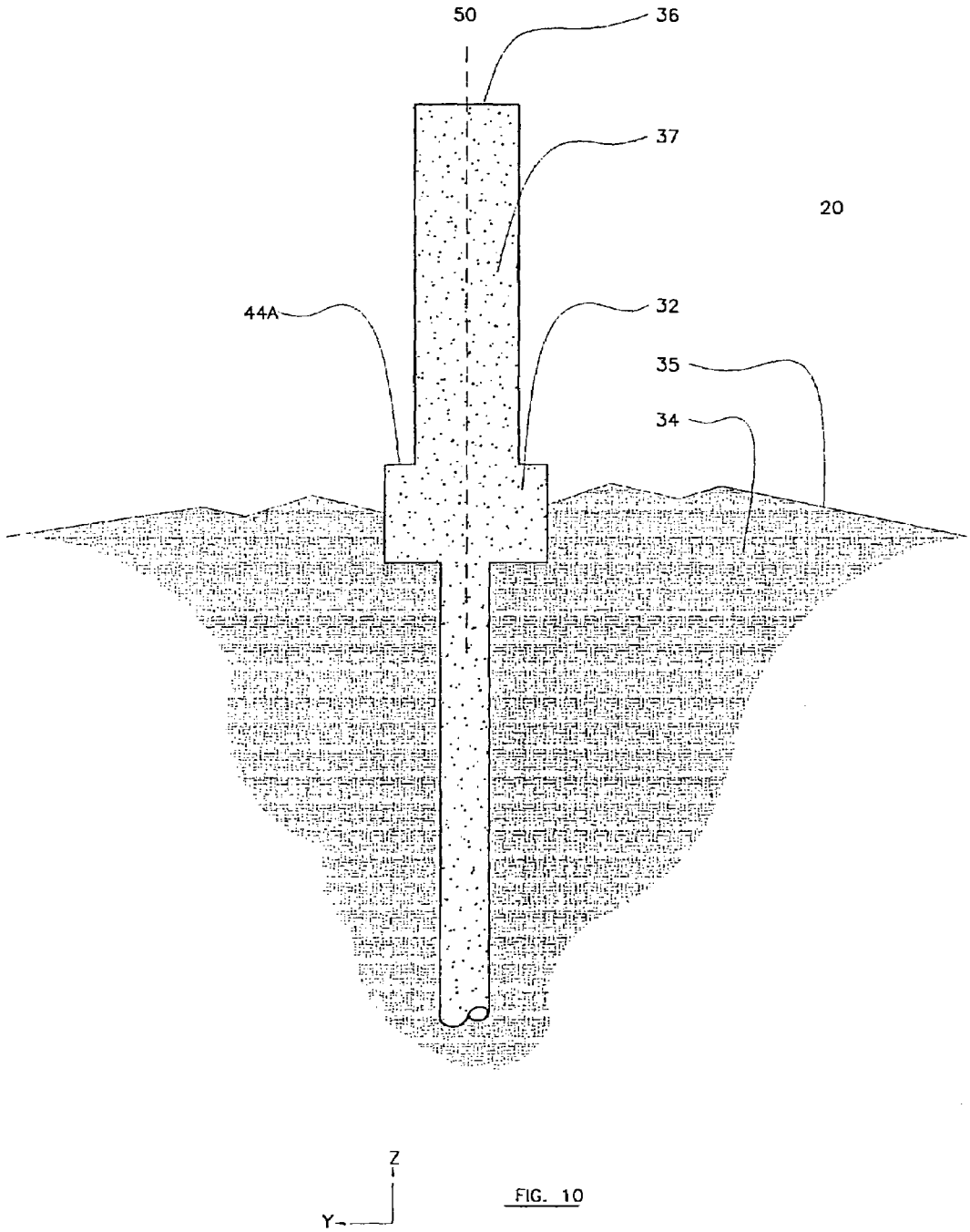
FIG. 10 is a vertical cross-sectional view of the upper and lower columns in the yz plane in which pile cap block is set above ground level.
Figure 11:
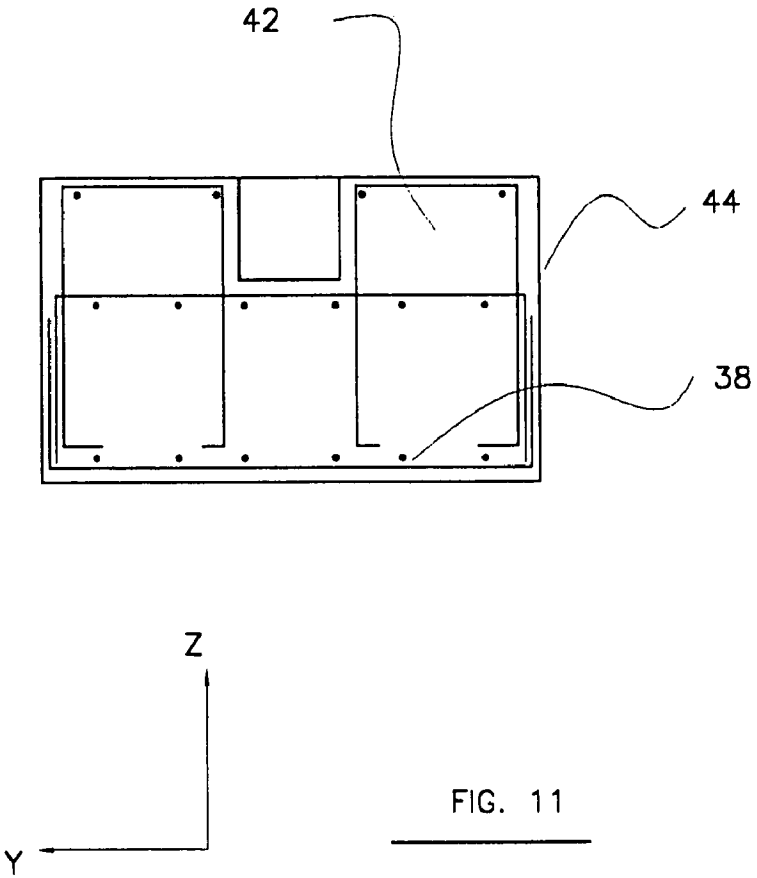
FIG. 11 is a horizontal cross-sectional view of a pile cap taken through Line 11—11 of FIG. 10.

In FIG. 10 is shown a second embodiment of the present invention in which pile cap block 232 projects above ground level 35. In this embodiment, a special purpose pile cap plate 44A (see FIG. 11) is employed.

Figure 12:
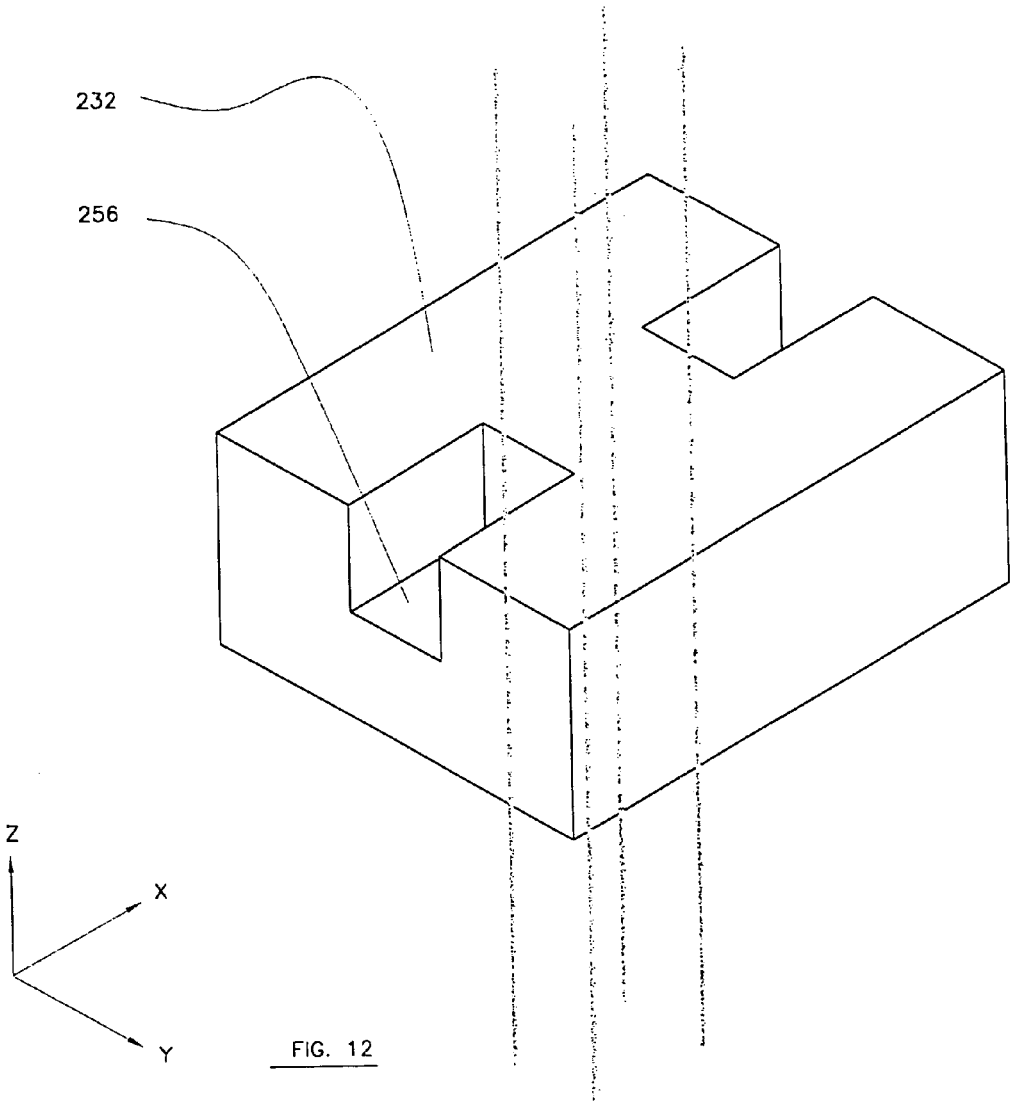
FIG. 12 is an isometric view of a pile cap block employed in a second embodiment of the inventive method.
Figure 13:
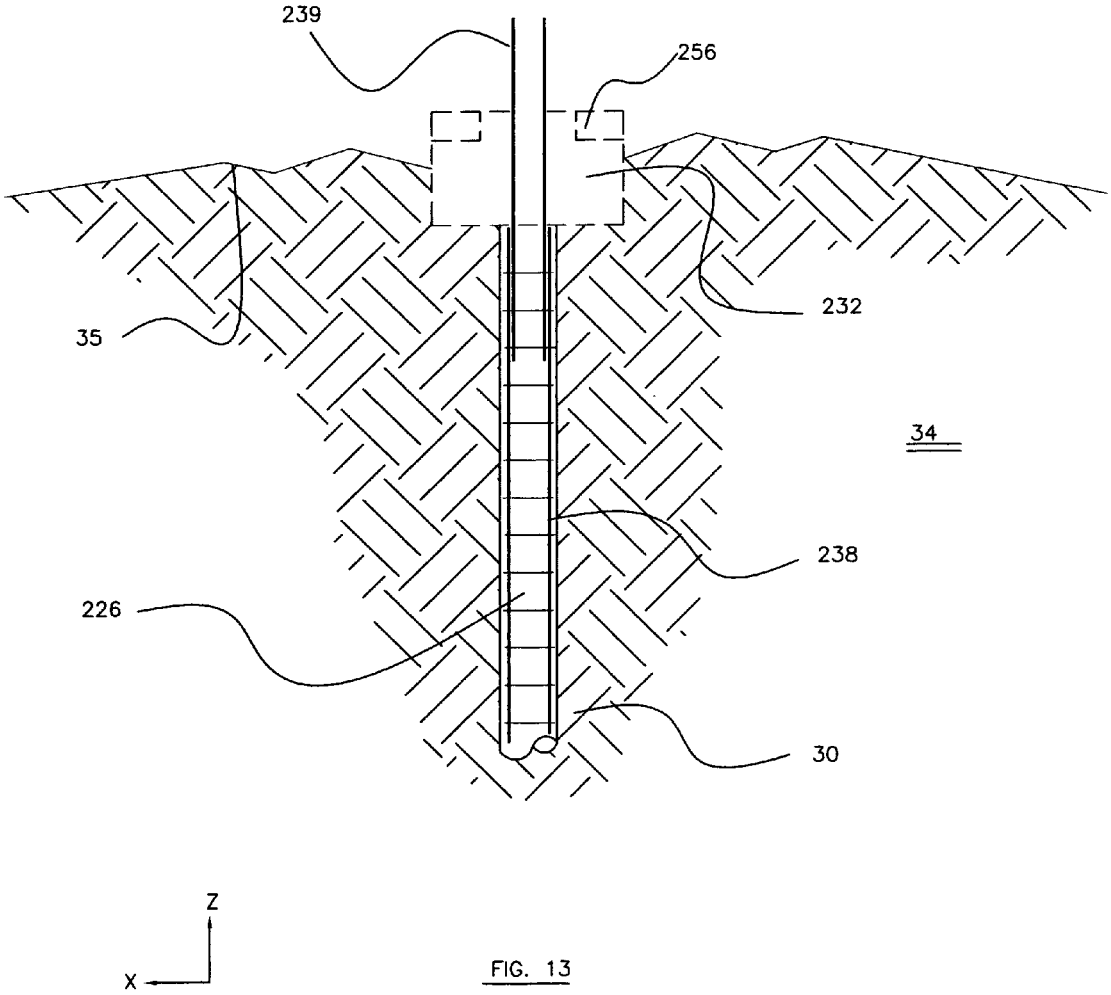
FIG. 13 is a front cross-sectional schematic view of first and second steps in said second embodiment of the inventive method.
Figure 14:
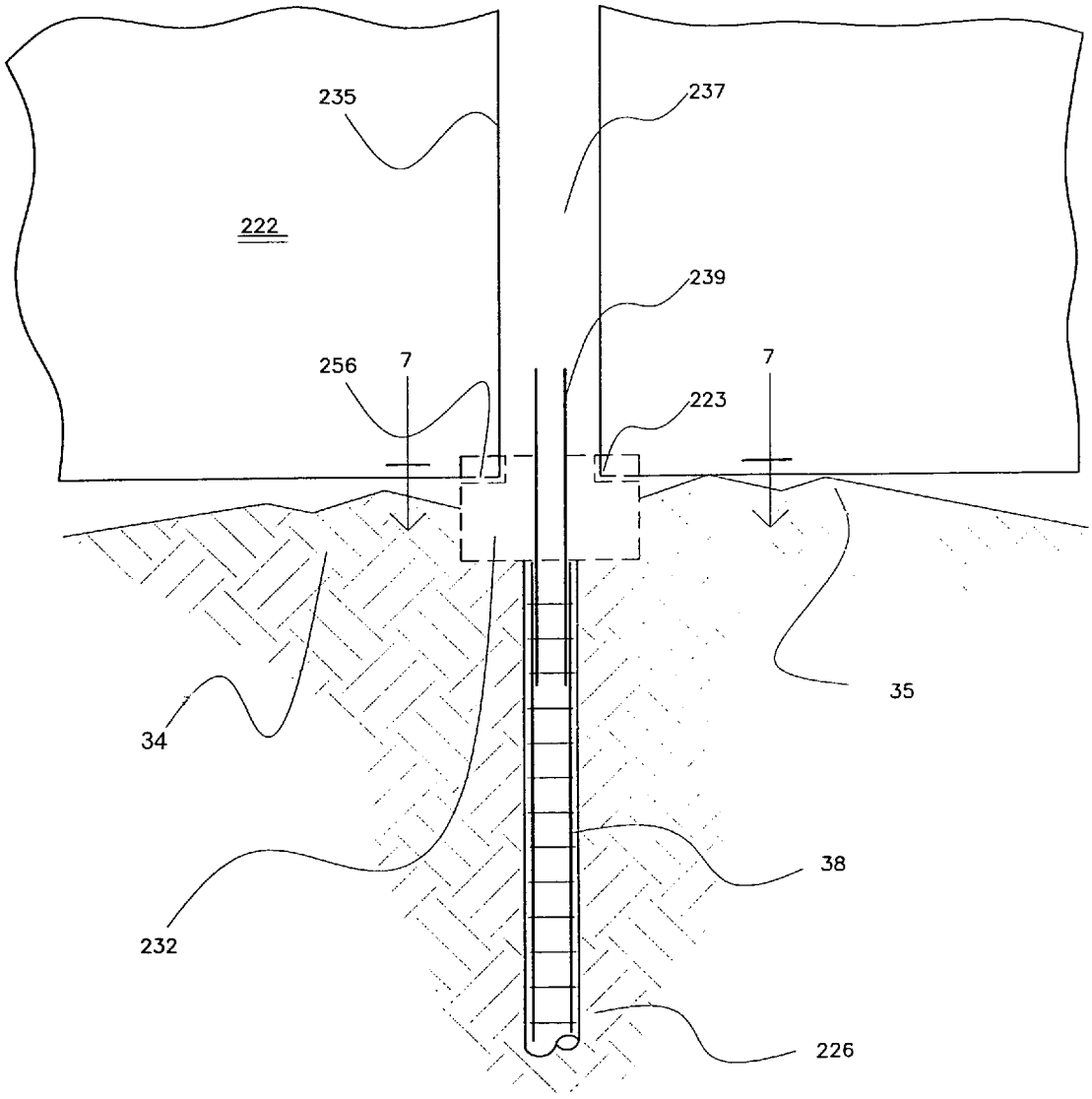
FIG. 14 is a front vertical schematic view showing a third step in said method.
Figure 14:
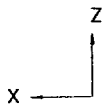
Figure 15:
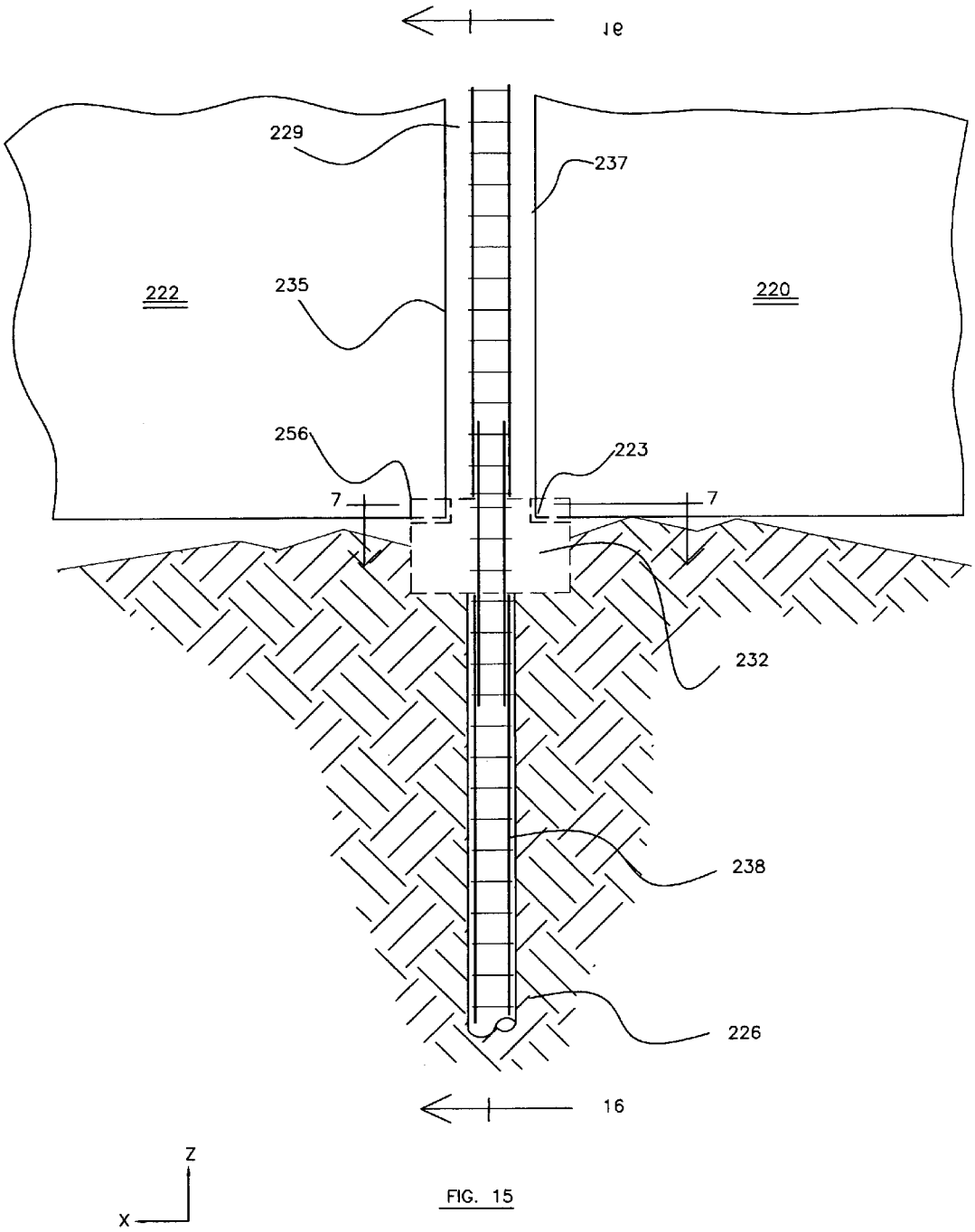
FIG. 15 is a vertical cross-sectional schematic view showing a fourth step in said method and the system resultant thereof.
Figure 16:
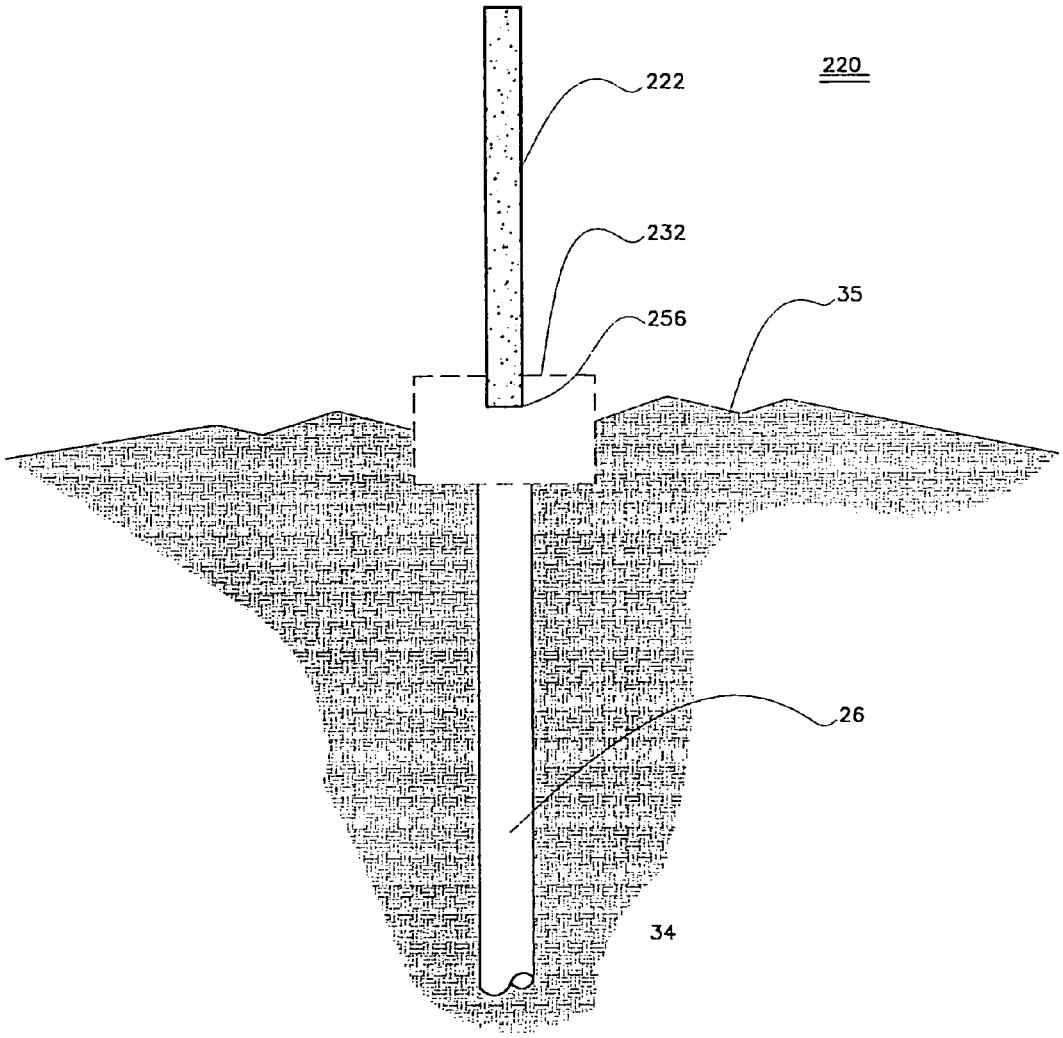
FIG. 16 is a vertical cross-sectional schematic view in the yz plane of the system of FIG. 15.
Figure 16:
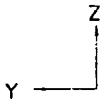

With reference to FIGS. 7 and 12, the steps of use of which are shown in FIGS. 13–15, and set forth below, pile cap block 232 may be seen to be of particular utility where panels of walls of the present system are to be positioned and secured at a height above ground level 35. Said block includes notches 256 at opposite panel plane sides thereof. However, said notches do not extend to the bottom horizontal wall at each block 232. See FIGS. 12, 13 and 16.

Turning to the method in which pile cap block 232 is employed, FIG. 13 shows a first step of augering a vertical pile hole 30 followed by the placement of vertical rebars 38 into said hole. Thereafter, pile cap block 232, which may be either pre-cast and placed on poured column 226 symmetrically about an axis of pile hole 30, having upper vertical rebars 39 cast therein and extending into uncured concrete, or may be concurrently cast in situ within auger hole 30 such that portions of said upper rebars 39 extend from lower cast column 226, through pile cap 232 and thereabove, as may be noted in FIGS. 13–15.

In a further step of said embodiment, opposing lower corners 223 of panels 222 are positioned within opposing cavities 256 of pile cap block 232 such that horizontal rebars 40 of said panels 222 project into a void space of a form within which upper column 237 is to be poured in the fashion above described with respect to FIG. 3–9 and form 43 thereof. The completed system of constructing the concrete column and wall system resultant of the present method is shown in FIGS. 15 and in the view of plane xz and FIG. 16 (a cross-sectional view taken along line 16—16 of FIG. 15).

Figure 17:
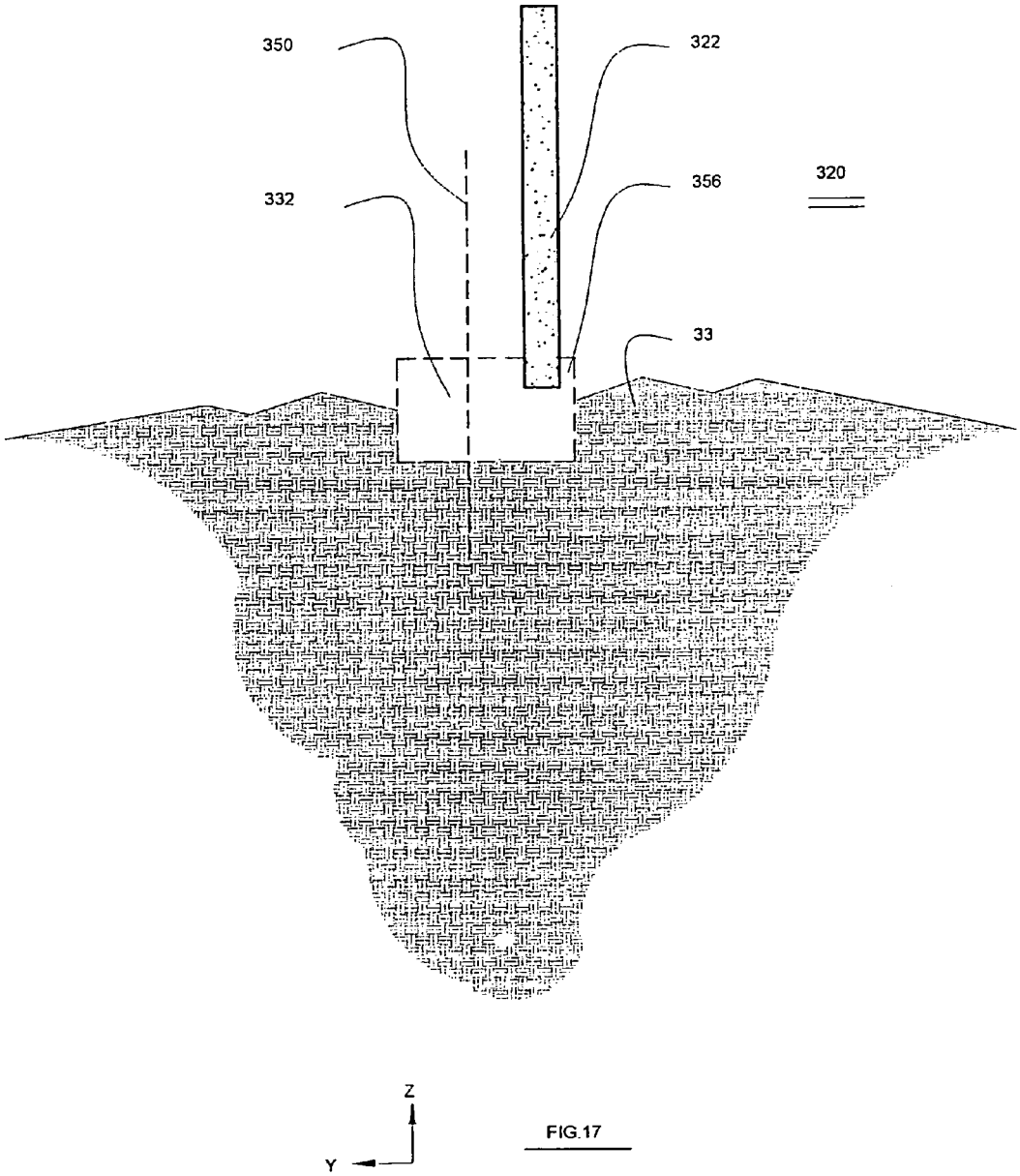
FIG. 17 is a vertical cross-sectional schematic view in the yz plane of an upper portion of a wall system resultant of a third embodiment of the present invention.
Figure 18:
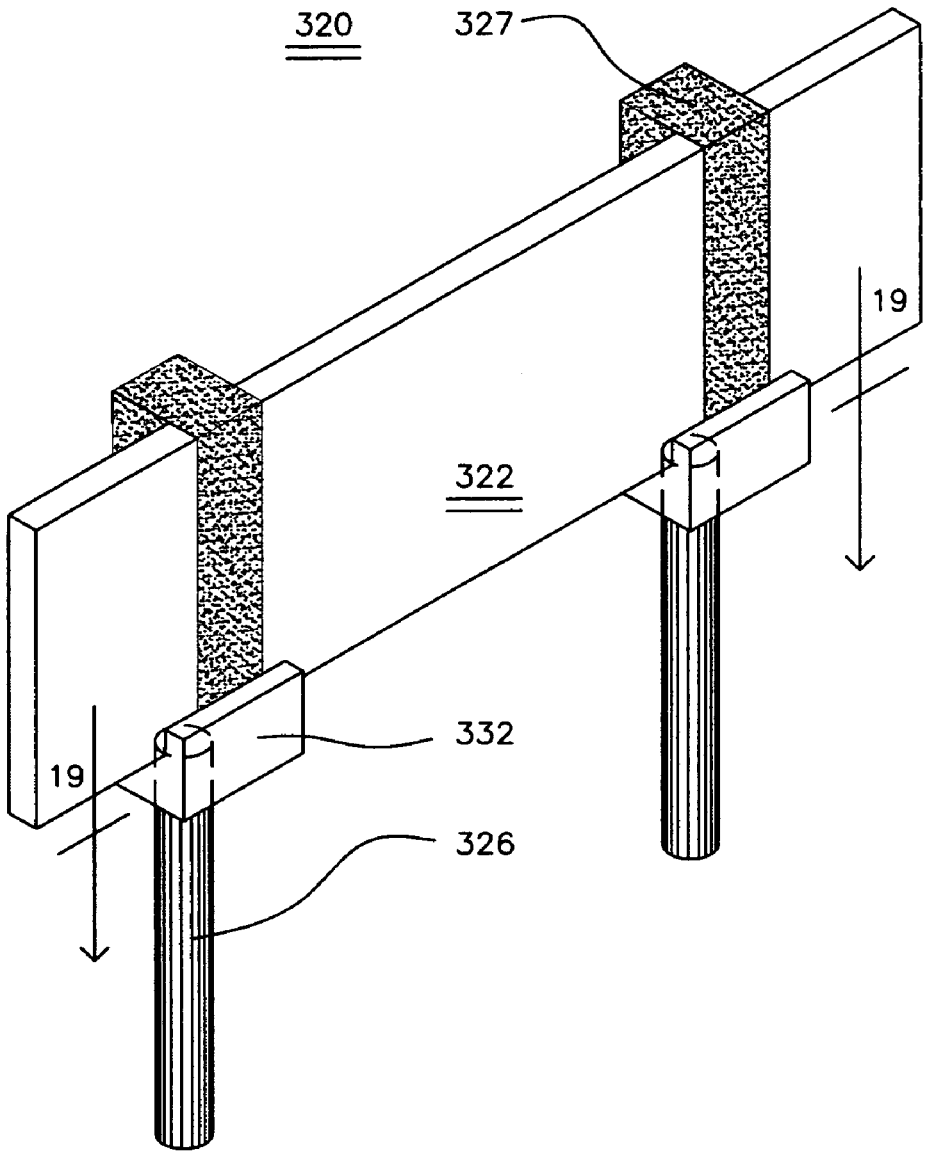
FIG. 18 is an isometric view of a column and panel system made in accordance with the method of FIG. 17.
Figure 18:
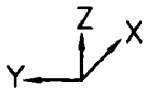
Figure 19:
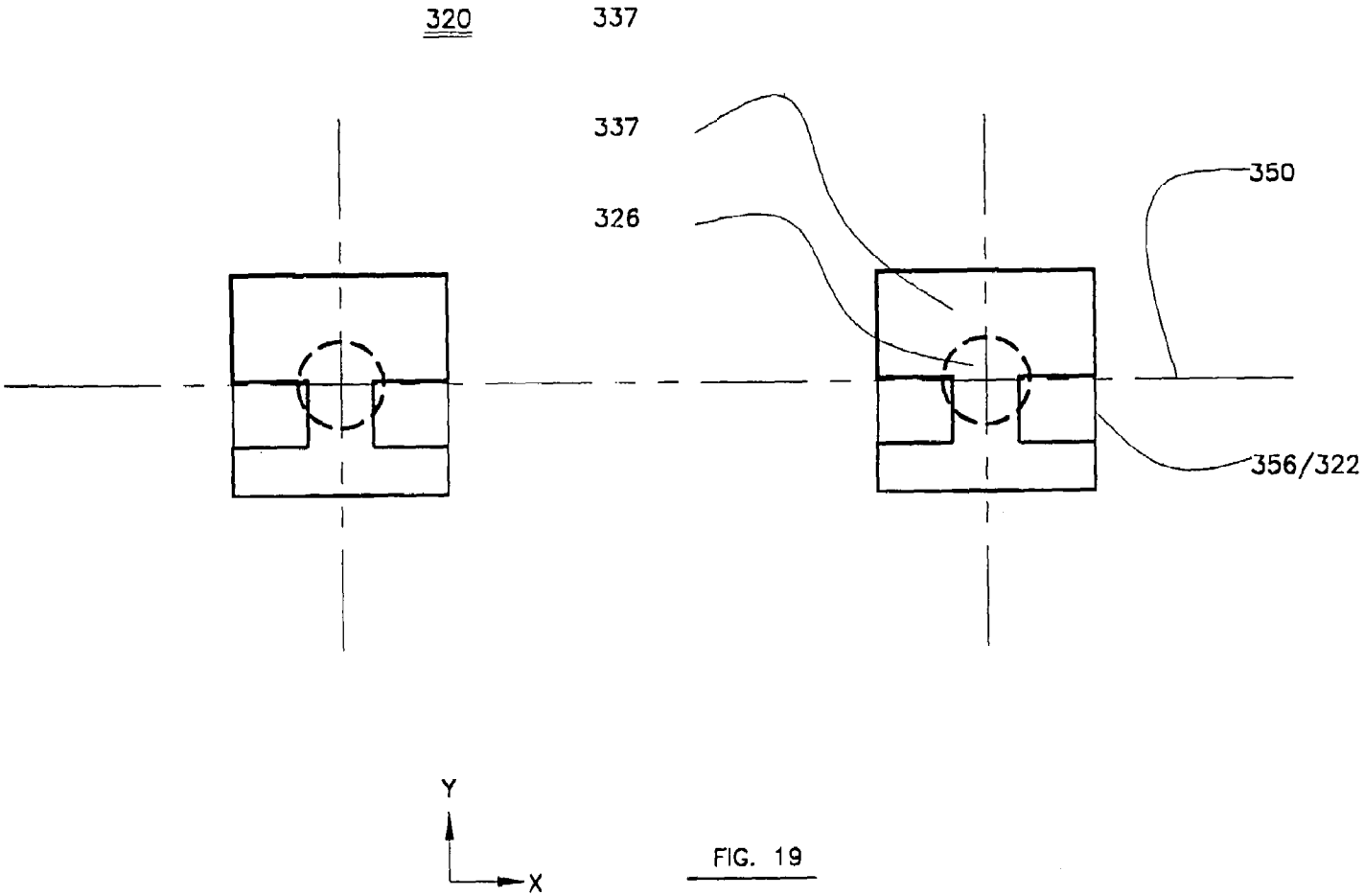
FIG. 19 is a horizontal schematic cross-sectional view taken through Line 19—19 of FIG. 18.

In FIGS. 17–19 is shown a variant of the embodiment of FIGS. 12–16 wherein a cavity 356 within a pile cap block 332 is positioned off center of z-axis centerline 350. A perspective view thereof is shown in FIG. 18, as is a XY plane cross-sectional view in FIG. 19 (taken along line 19—19 of FIG. 18). This embodiment is useful in applications where additional space upon pile cap block 332 at one side of panel 322 is useful and a reduced surface area upon pile cap block 332 on the opposite side of panel 322 is necessary or is undesirable.

Figure 20:
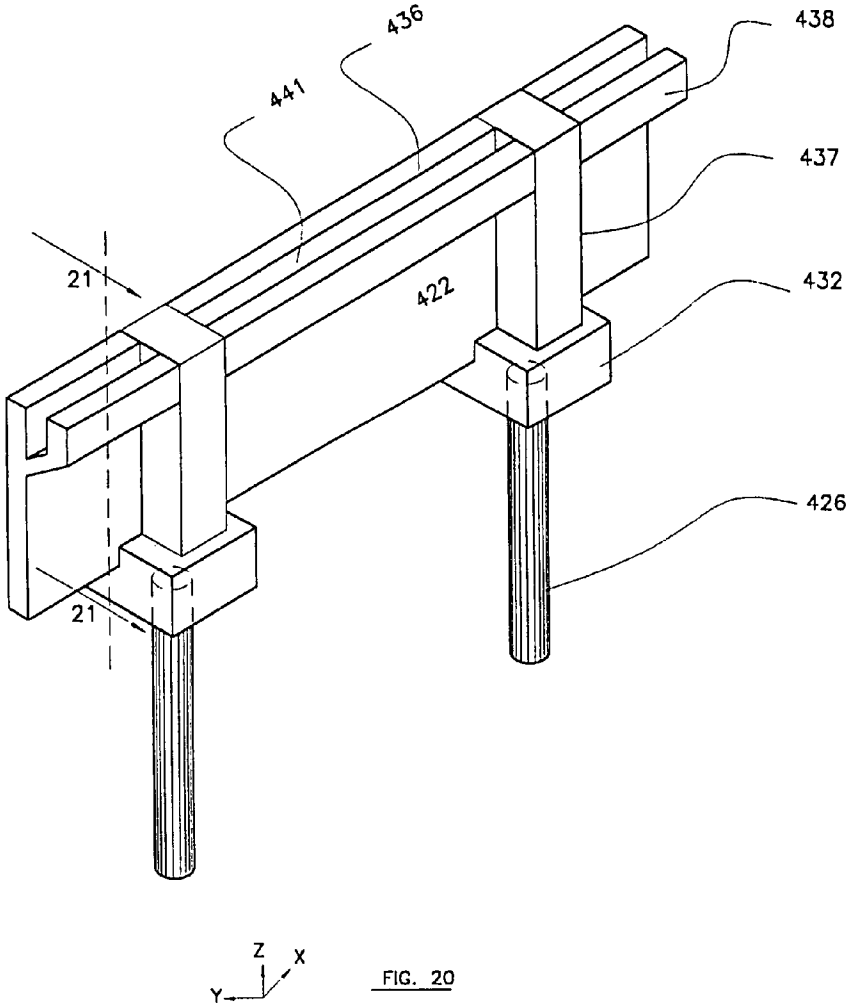
FIG. 20 is an isometric view of a system resultant of a fourth embodiment of the inventive method.
Figure 21:
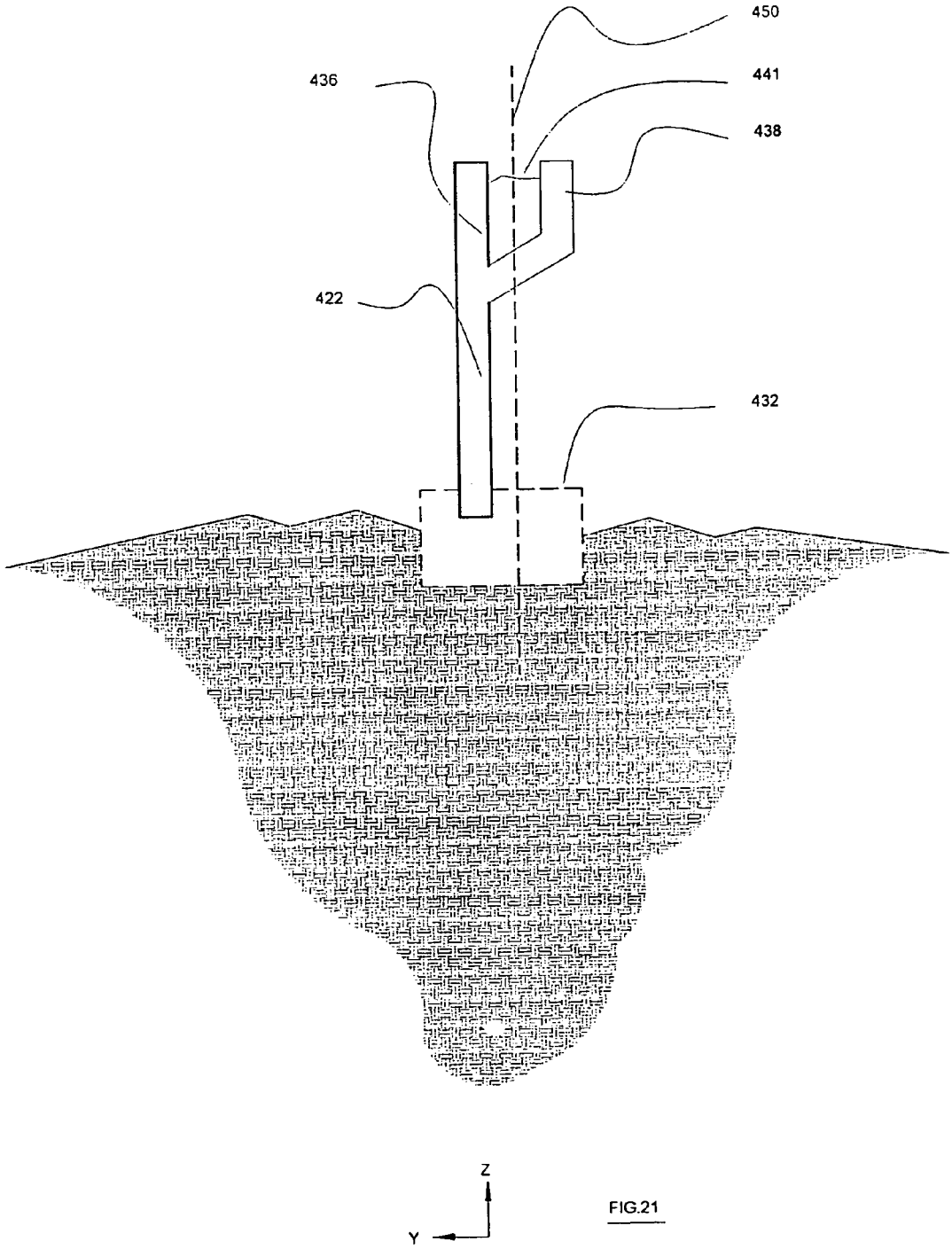
FIG. 21 is a vertical cross-sectional view of the upper portion of the system of FIG. 20 taken in the yz plane thereof.

A yet further embodiment of the present invention is shown in FIGS. 20–21. This embodiment differs from that of FIGS. 17–19 in that an upper x-axis edge of panel 422 is provided with parallel elements 436 and 438 within which a channel 441 is provided. Such a channel may have various uses including holding of soil within which vegetation may be planted and the protection of electronic gear, having a security function, in the protection of facilities behind panels

422 and columns 437. Also shown in FIGS. 20–21 is z-axis centerline 450, pile cap block 432 and lower in-ground column 426.

While there has been shown and described the preferred embodiment of the instant invention, it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

The invention claimed is:

1. A method of constructing a concrete column and wall fence system, comprising the steps of:

(a) auguring a vertical pile hole;

(b) excavating an at least partially ground level recess for a pile cap above and about said pile hole;

(c) placing vertical rebars into said vertical pile hole and pile cap recess;

(d) pouring concrete in situ into said pile hole and pile cap recess to thereby form a lower part of said column and said pile cap;

(e) positioning a pile cap plate on said poured concrete pile cap of step (d) prior to the curing thereof;

(f) positioning opposing vertical edges of pre-cast concrete panels upon opposite sides of said pile cap plate;

(g) using vertical forms to define in horizontal cross-section about said opposing edges of said panels, a substantially H-shaped geometry having vertical rebars therein, said panel ends having horizontal re-bars extending into said geometry, thus horizontally and vertically positioning re-bars within an entirely above-ground length of said geometry; and (h) casting columns in situ, within said H-shaped geometry, volumes defined by said forms, thereby forming an upper part of said concrete column usable in a wall fence system in which casted columns are integral and rigid relative to said panels by reason of said geometry of each column.

2. The method as recited in claim 1, further comprising the step of:

(i) welding opposing pile cap and panel bottom plates to each other after said casting Step (e) above.

3. A method of constructing a concrete column and wall fence system, comprising the steps of:

(a) auguring a vertical pile hole;

(b) excavating an at least partially ground level recess for a pile cap above and about said pile hole;

(c) placing vertical rebars into said vertical pile hole and pile cap recess;

(d) pouring concrete in situ into said pile hole to thereby form a lower part of said column;

(e) positioning a pre-cast pile cap block on said poured concrete of step (d) prior to the curing thereof;

(f) positioning opposing vertical edges of pre-cast concrete panels upon or within opposite ends of said pile cap block;

(g) using vertical forms to define about said opposing edges of said panels, a substantially H-shaped above-ground geometry having vertical rebars therein, said panel ends having horizontal re-bars extending into said geometry, thus horizontally and vertically positioning re-bars within an entirely above-ground length thereof; and (h) casting an upper part of said column in situ in said H-shaped geometry within volumes defined by said forms, thereby forming an upper part of said concrete column and usable in a wall fence system in which said casted columns are integral and rigid relative to said panels by reason of said geometry of each column.

4. The method as recited in claim 3, in which said upper edge of one or more of said panels comprises a plantar.

* * * * *